US009631308B2

(12) United States Patent
Hayashida et al.

(10) Patent No.: US 9,631,308 B2
(45) Date of Patent: Apr. 25, 2017

(54) SEWING MACHINE FOR HEM

(71) Applicant: Yamato Mishin Seizo Kabushiki Kaisha, Osaka-shi, Osaka (JP)

(72) Inventors: Takayuki Hayashida, Toyonaka (JP); Takashi Iba, Toyonaka (JP)

(73) Assignee: Yamato Mishin Seizo Kabushiki Kaisha, Osaka-shi, Osaka (JP)

( * ) Notice: Subject to any disclaimer, the term of this patent is extended or adjusted under 35 U.S.C. 154(b) by 0 days.

(21) Appl. No.: 14/969,829

(22) Filed: Dec. 15, 2015

(65) Prior Publication Data

US 2016/0177484 A1 Jun. 23, 2016

(30) Foreign Application Priority Data

Dec. 19, 2014 (JP) ..... 2014-257616

(51) Int. Cl.

| | |
|---|---|
| ***D05B 35/02*** | (2006.01) |
| ***D05B 35/10*** | (2006.01) |
| ***D05B 29/02*** | (2006.01) |
| ***D05B 29/08*** | (2006.01) |
| ***D05B 35/08*** | (2006.01) |

(52) U.S. Cl.

CPC ..... *D05B 35/02* (2013.01); *D05B 29/02* (2013.01); *D05B 29/08* (2013.01); *D05B 35/08* (2013.01); *D05B 35/10* (2013.01)

(58) Field of Classification Search

CPC ..... D05B 35/00; D05B 35/02; D05B 35/04; D05B 35/06; D05B 35/08; D05B 35/10; D05B 35/102; D05B 29/00; D05B 29/06; D05B 29/02; D05B 29/08; D05B 19/00; D05B 37/08; D05B 27/10; D05B 27/12; D05B 27/14; D05B 27/16

See application file for complete search history.

(56) References Cited

U.S. PATENT DOCUMENTS

| | | | | |
|---|---|---|---|---|
| 3,616,771 A * | 11/1971 | Gray et al. | ..... | D05B 23/00 112/153 |
| 3,865,058 A * | 2/1975 | Rovin | ..... | D05B 33/00 112/10 |
| 4,493,277 A * | 1/1985 | Sanvito | ..... | D05B 35/10 112/153 |

(Continued)

FOREIGN PATENT DOCUMENTS

| | | |
|---|---|---|
| JP | H10-235054 A | 9/1998 |
| JP | 2015-062481 A | 4/2015 |

*Primary Examiner* — Ismael Izaguirre

(74) *Attorney, Agent, or Firm* — Bret E. Field; Bozicevic, Field & Francis LLP

(57) ABSTRACT

A sewing machine for hem includes a turn-back device provided in front of a needle location position on a sewing machine bed, the turn-back device turning back an edge part of cloth into a state of being folded one above the other, and then feeding the turned-back cloth. In front of the turn-back device, a feed belt and a cloth presser foot are arranged opposite to each other with a cloth feeding path in between. By virtue of operation of a rotary solenoid performed on the basis of a detection result of a detector arranged in front of the opposing portion, the cloth presser foot is raised and lowered and thereby holds the cloth in cooperation with the feed belt so as to exert a movement force in the right and left directions onto the cloth.

5 Claims, 6 Drawing Sheets

(56) References Cited

U.S. PATENT DOCUMENTS

| | | | | | |
|---|---|---|---|---|---|
| 5,054,409 | A * | 10/1991 | Schips | D05B 35/102 | 112/153 |
| 5,383,410 | A * | 1/1995 | Mukai | D05B 33/00 | 112/143 |
| 5,899,159 | A * | 5/1999 | Dasher | D05B 35/10 | 112/143 |
| 5,918,560 | A * | 7/1999 | Dasher | D05B 35/02 | 112/141 |
| 6,119,612 | A * | 9/2000 | Bottoms | D05B 35/04 | 112/141 |
| 6,202,579 | B1 * | 3/2001 | Olewicz | D05B 11/005 | 112/2.1 |
| 2015/0083033 | A1 | 3/2015 | Hayashida et al. | | |

* cited by examiner

SEWING MACHINE FOR HEM

CROSS REFERENCE TO RELATED APPLICATIONS

This non-provisional application claims priority under 35 U.S.C. §119(a) on Patent Application No. 2014-257616 filed in Japan on Dec. 19, 2014, the entire contents of which are hereby incorporated by reference.

TECHNICAL FIELD

The present invention relates to a sewing machine for hem used in order to implement hem sewing in which an edge part of cloth is turned back and sewed up across a predetermined width.

BACKGROUND

Hem portions of various clothing are finished by hem sewing in which an edge part of cloth is turned back across a predetermined width and then folded under the remaining portion and, after that, the vicinity of the edge is sewed up. When the hem sewing is to be performed by using a common sewing machine, the work of turning back and folding, while maintaining a constant width, the edge of the cloth fed to a needle location position is to be performed by hand. This work needs skill and there is a possibility of causing various poor sewing like the folding width is insufficient so that some portions are not allowed to be sewed up and, on the contrary, the folding width is excessive so that a seam line is formed at a position distant from the edge.

In view of such situations, a sewing machine for hem has been proposed that comprises a turn-back device provided in front of the needle location position and is thereby capable of implementing satisfactory hem sewing without the necessity of skill (for example, see Japanese Patent Application Laid-Open No. H10-235054). The turn-back device includes: a guide plate that is located in a recess provided in front of the needle location position and that protrudes in parallel to a needle plate; a ruler member extending in parallel to an upper face of the guide plate and then being bent at a position opposing a tip part of the guide plate so as to be continuous to the bottom face of the recess; and an air ejection outlet being opened in the bent part of the ruler member and ejecting air to a space between the guide plate and the recess. Cloth is supplied along the upper face of the guide plate in a state that an edge part thereof is bent along the bent part of the ruler member. Then, the cloth is fed out in a direction along the tip part of the guide plate. The air ejected from the air ejection outlet flows through a space between a lower face of the guide plate and the recess at a high speed and thereby biases the cloth overlapping with the lower face of the guide plate toward a direction substantially perpendicular to the feed direction so as to press the edge of the cloth against an end face of the recess.

In the sewing machine for hem, the cloth introduced into the turn-back device is folded one above the other with the guide plate in between. Then, by virtue of the above-described pressing to the end face of the recess, the folding width of the edge part has a substantially fixed value corresponding to the amount of protrusion of the guide plate. Thus, it is sufficient that an operator performs the work of holding the cloth in front of the turn-back device so as to assist the introduction into the turn-back device. Accordingly, hem sewing is allowed to be simply implemented.

SUMMARY

In the sewing machine for hem having the above-described configuration, in some cases, the cloth prior to the introduction into the turn-back device is displaced in the right and left directions owing to the effect of an external force such as the self-weight. Then, in a case that this displacement has occurred excessively, the above-described folding posterior to the introduction is not appropriately achieved.

The above-described assisting work by an operator is performed in order to correct the displacement of the cloth in the right and left directions. However, for example, in a case that cloth to be sewed up has a curved edge, the displacement of the edge in the right and left directions is enhanced. Thus, a problem is caused that, in particular, when an operator having insufficient experience is to perform the assisting work, the cloth is introduced into the turn-back device in a state that the position adjustment in the right and left directions is insufficient, and hence satisfactory hem sewing is not allowed to be implemented.

The present invention has been devised in view of such situations. An object thereof is to provide a sewing machine for hem in which position adjustment of an edge of cloth in the right and left directions is automatically performed and hence even when the cloth has a curved edge, hem sewing is allowed to be implemented without the necessity of assistance by an operator.

The sewing machine for hem according to the present invention is a sewing machine for hem, comprising: a turn-back device arranged in front of a needle location position on a sewing machine bed, the turn-back device turning back an edge part of cloth into a state of being folded one above the other, and then feeding the turned-back cloth to the needle location position; a feed belt arranged in front of the turn-back device and moving in right and left directions below a cloth feeding path; a cloth presser foot opposing the feed belt with the cloth feeding path in between; a drive section raising or lowering the cloth presser foot between a holding position where the cloth presser foot is lowered so as to hold the cloth in cooperation with the feed belt and a non-holding position where the cloth presser foot is raised so as to be away from the feed belt; a detector arranged in front of an opposing portion of the feed belt and the cloth presser foot, and detecting passage of an edge of cloth; and a control section causing the drive section to operate so as to raise or lower the cloth presser foot between the holding position and the non-holding position, on the basis of detection by the detector.

Moreover, the sewing machine for hem according to the present invention is characterized by further comprising a correction device arranged in front of the opposing portion of the feed belt and the cloth presser foot, and correcting curl occurring in an edge part of cloth, wherein the detector is arranged between the correction device and the opposing portion of the feed belt and the cloth presser foot.

Moreover, the sewing machine for hem according to the present invention is characterized in that the cloth presser foot is provided with a presser ball rolling in contact with cloth, in a portion of opposing the feed belt.

Moreover, the sewing machine for hem according to the present invention is characterized by further comprising a raising/lowering section raising or lowering the cloth presser foot together with the drive section between a distant position distant above the feed belt and a close position close to the feed belt.

Moreover, the sewing machine for hem according to the present invention is characterized in that the drive section is provided with: a rotary solenoid lowering the cloth presser foot; and a bias spring raising the cloth presser foot.

In the sewing machine for hem according to the present invention, the feed belt and the cloth presser foot are arranged in front of the turn-back device and then, the cloth presser foot is raised and lowered in accordance with the control performed by the control section on the basis of detection of passage of the edge of cloth obtained by the detector. Thus, the cloth is held by the cloth presser foot lowered to the holding position and the feed belt and then the displacement of the cloth in the right and left directions is automatically corrected by the operation of the feed belt so that the cloth is appropriately fed to the needle location position via the turn-back device. Thus, satisfactory hem sewing is allowed to be simply implemented without the necessity of assistance by the operator. As such, the present invention provides excellent effects.

The above and further objects and features will more fully be apparent from the following detailed description with accompanying drawings.

DETAILED DESCRIPTION

Figure 1:
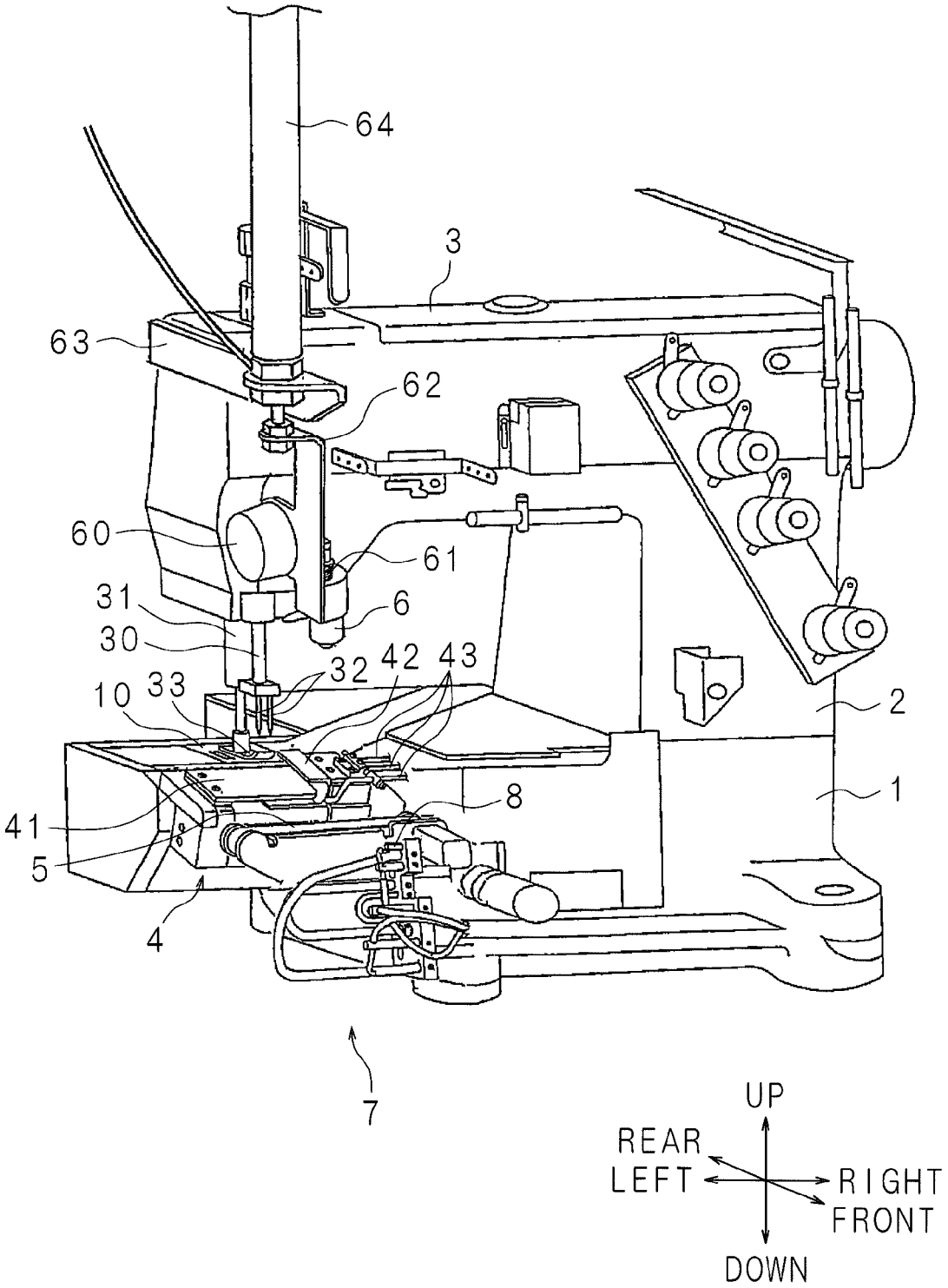
FIG. 1 is an external-appearance perspective view of a sewing machine for hem according to an embodiment.
Figure 2:
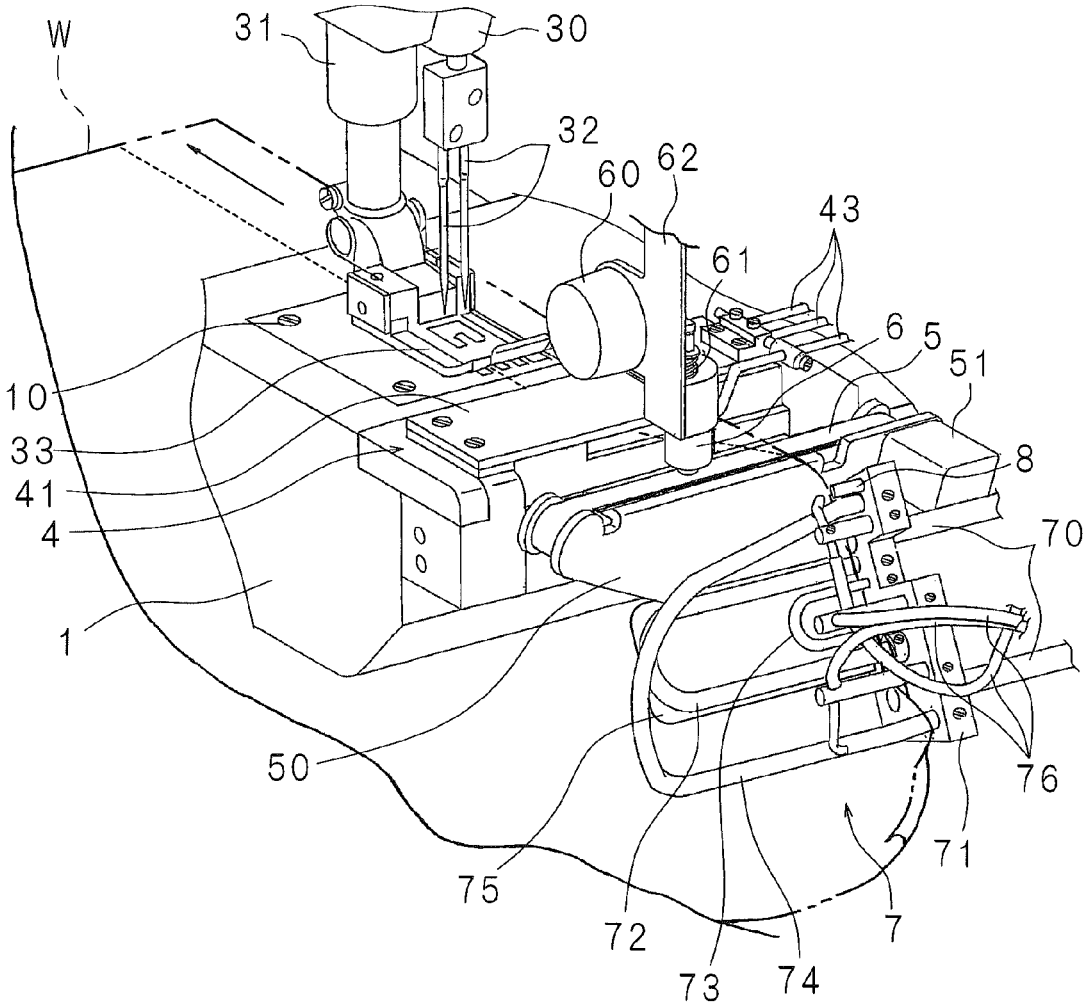
FIG. 2 is a perspective view illustrating a vicinity of a needle location position in an enlarged manner.

The present invention is described below in detail with reference to the drawings illustrating an embodiment. FIG. 1 is an external-appearance perspective view of a sewing machine for hem according to an embodiment. FIG. 2 is a perspective view illustrating the vicinity of a needle location position in an enlarged manner. In the following description, "up and down", "right and left", and "front and rear" indicated by arrows in FIG. 1 are employed. Here, the "front" indicates a near side relative to a sewing worker and the "rear" indicates a far side relative to the sewing worker. The "right and left" indicate "right and left" viewed from front.

As illustrated in FIG. 1, the sewing machine for hem comprises a sewing machine bed 1, a pedestal 2, and a sewing machine arm 3. The sewing machine bed 1 is provided with a bed member having a rectangular box shape and with a cylindrical bed protruding leftward from a left side face of the bed member, and is fixed and supported on a table (not illustrated). A needle plate 10 is provided in an upper face of the cylindrical bed. Further, a feed device and a looper device (not illustrated) are arranged below the needle plate 10. The feed device and the looper device are linked to a sewing machine motor (not illustrated) serving as a driving source, via individual drive mechanisms located in the sewing machine bed 1. Then, the feed device and the looper device individually perform known operations in association with the drive of the sewing machine motor.

The pedestal 2 is vertically installed in a right side part on an upper face of the sewing machine bed 1. The sewing machine arm 3 extends from an upper end part of the pedestal 2 to left. Then, a needle bar 30 and a presser bar 31 are supported in a left end part of the sewing machine arm 3 in a manner of being aligned frontward and rearward. The needle bar 30 and the presser bar 31 extend downward from the sewing machine arm 3 toward the needle plate 10 on the cylindrical bed. Then, a needle 32 and a presser plate 33 are attached to respective lower end parts of the needle bar 30 and the presser bar 31.

The needle bar 30 is linked to the sewing machine motor via a needle-bar drive mechanism provided in the sewing machine arm 3 and hence rises and lowers in association with the drive of the sewing machine motor. In accordance with the rising and lowering of the needle bar 30, the needle 32 repeats rising and lowering in synchronization with the feed device and the looper device arranged below the needle plate 10.

The presser bar 31 rises and lowers by an operation, for example, a pedal operation, by the operator. The presser plate 33 having been lowered approaches the needle plate 10 so as to hold cloth W (see FIG. 2) in cooperation with the needle plate 10. The cloth W held in this manner is fed and moved rearward as indicated by an arrow in FIG. 2 in accordance with the operation of the feed device. Then, the cloth W is sewed at the needle location position (a lowering position of the needle 32) by virtue of the operation of the needle 32 and the looper device performed in synchronization with the feed movement. During this time, the presser plate 33 rises and lowers in accordance with the operation of the feed device so as to maintain the holding state of the cloth W.

The sewing machine for hem further comprises a turn-back device 4. The turn-back device 4 is a known device disclosed in Japanese Patent Application Laid-Open No. H10-235054. Then, as illustrated in FIG. 1, the turn-back device 4 includes a guide plate 41 and a ruler member 42 arranged in front of the needle location position. By virtue of operations of these components, an edge part of the cloth W fed to the needle location position is turned back downward across a constant width and then fed out in a manner of being folded under the remaining portion.

In the turn-back device 4, a plurality of air pipes 43 introducing high-pressure air from an air supply (not illustrated) are provided and aligned frontward and rearward. The air supplied from the air pipe 43 provided on the front side is ejected leftward from an air ejection nozzle of the turn-back device 4 on the front side of the guide plate 41 and the ruler member 42. The ejected air is sprayed to the edge part of the cloth W and thereby turns back the edge part downward so as to assist introduction into a space between the guide plate 41 and the ruler member 42.

The air supplied from the remaining air pipes 43 is ejected from air ejection nozzles of the turn-back device 4 on the inner side of the ruler member 42, along a lower face of the guide plate 41. Thus, the air biases leftward the edge part of the cloth W overlapping with the lower face of the guide plate 41 and thereby overlays the edge part on the remaining portion across a width corresponding to the length of the guide plate 41. The cloth W in this state is fed to the needle location position and then sewed together in a state of overlapping across the constant width.

The sewing machine for hem further comprises a feed belt 5 and a cloth presser foot 6. The feed belt 5 is stretched in the right and left directions between pulleys supported by a bearing bracket 50, and is arranged in front of the turn-back device 4. The feed belt 5 includes a feed surface opposing a lower side of a feed path for the cloth W. The feed surface is moved rightward in association with the drive of a belt motor 51 fixed to a right side part of a front face of the bearing bracket 50.

The cloth presser foot 6, together with a rotary solenoid 60 (a drive section) and a bias spring 61 (a drive section), is supported by a support board 62 and then opposes the feed surface of the feed belt 5 from above. As illustrated in FIG. 1, in an upper part of a tip part of the sewing machine arm 3, a raising/lowering cylinder 64 (a raising/lowering section) is supported via a bracket 63 protruding frontward. Then, the support board 62 is fixed to an output end of the raising/lowering cylinder 64 protruding downward. For example, the raising/lowering cylinder 64 is constructed from a pneumatic cylinder operating in response to feeding and discharging of operation air. Then, in accordance with the operation of the raising/lowering cylinder 64, the cloth presser foot 6 rises and lowers together with the support board 62, the rotary solenoid 60, and the bias spring 61 so as to perform vertical motion between a distant position sufficiently distant above the feed belt 5 as illustrated in FIG. 1 and a close position close to the feed belt 5 as illustrated in FIG. 2.

Figure 3A:
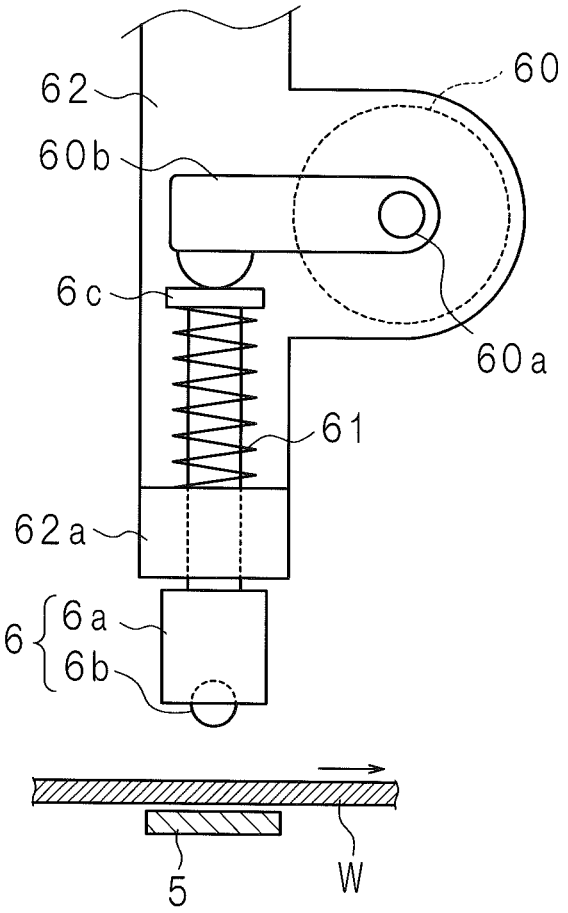
FIGS. 3A and 3B are explanation diagrams for a configuration and operation of a cloth presser foot.
Figure 3B:
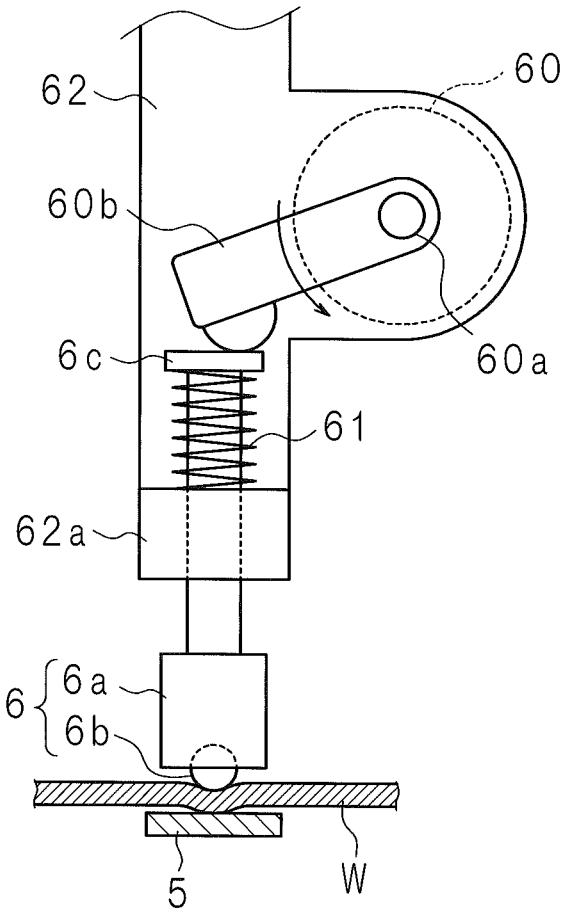

FIGS. 3A and 3B are explanation diagrams for the configuration and the operation of the cloth presser foot 6, in which the cloth presser foot 6 located at the above-described close position is viewed together with the feed belt 5 and the cloth W from a right side of the support board 62. As illustrated in the figures, the cloth presser foot 6 is provided with: a presser rod 6*a* supported by a support cylinder 62*a* provided in a lower part of the support board 62 in a manner of permitting vertical motion; and a presser ball 6*b* held at a lower end of the presser rod 6*a* in a manner of permitting rolling. A collar 6*c* is attached to an upper end part of the presser rod 6*a* protruding above the support cylinder 62*a*. The bias spring 61 is inserted between the support cylinder 62*a* and the collar 6*c* so as to exert an upward bias force on the presser rod 6*a*.

As illustrated in FIG. 1 and FIG. 2, the rotary solenoid 60 is fixed to a left side face of the support board 62 and includes an output end 60*a* protruding in a right side face of the support board 62 as illustrated in FIGS. 3A and 3B. Then, a presser lever 60*b* extending frontward is fixed to the output end 60*a*. A tip part of the presser lever 60*b* abuts against the collar 6*c* attached to the upper end part of the presser rod 6*a*, from above.

FIG. 3A illustrates a non-operating state of the rotary solenoid 60. At that time, the presser rod 6*a* is raised by the biasing of the bias spring 61 and thereby presses the collar 6*c* against the presser lever 60*b*. The presser ball 6*b* held at the lower end of the presser rod 6*a* is located at a position (a non-holding position) of opposing the cloth W fed and moved on the feed belt 5 with an appropriate distance in between.

FIG. 3B illustrates an operating state of the rotary solenoid 60. In accordance with the operation of the rotary solenoid 60, the presser lever 60*b* rotates counterclockwise in FIG. 3B by a predetermined angle so as to press the collar 6*c* downward. The presser rod 6*a* is lowered and moved to the holding position by the pressing of the presser lever 60*b*, against the biasing of the bias spring 61. Then, the presser ball 6*b* held at the lower end of the presser rod 6*a* goes into contact with the cloth W on the feed belt 5 and thereby presses the cloth W downward so as to hold the cloth W in cooperation with the feed belt 5. By virtue of this, a feed force in the moving direction of the feed surface of the feed belt 5 acts on the cloth W so that the cloth W is moved in the right and left directions.

The presser ball 6*b* held at the lower end of the presser rod 6*a* rolls when being in contact with the cloth W. Thus, the cloth W is allowed to smoothly move in contact with the feed belt 5. Here, the employed drive section of the cloth presser foot 6 is not limited to the rotary solenoid 60 and the bias spring 61 illustrated in the figures and hence an appropriate configuration such as a linear solenoid and a pneumatic cylinder may be employed that permits rapid vertical motion of the cloth presser foot 6.

The sewing machine for hem further comprises a correction device 7. The correction device 7 has the configuration proposed in Japanese Patent Application No. 2013-197154 filed by the applicants of this application. That is, the correction device 7 is a device in which curl occurring in an edge part of cloth W is corrected before the introduction into the turn-back device 4. Further, as illustrated in FIG. 2, the correction device 7 includes: a support plate 71 supported by two support rods 70 and 70; and cloth supports 72, 73, and 74 and an air receiving plate 75 attached to the support plate 71.

The support rods 70 and 70 extend in the right and left directions in front of the sewing machine bed 1 and is slidable in the extension direction. The support plate 71 is a flat plate attached to left end parts of the support rods 70 and 70 perpendicularly to these. Then, a position of the support plate 71 is adjustable in the right and left directions in association with the slide movement of the support rods 70 and 70. The cloth supports 72, 73, and 74 are circular cross-sectional pipes bent in a U-shape and are attached to a left side face of the support plate 71 such that the bent parts serving as tip sides extend leftward.

The cloth support 72 is provided in the vicinity of an edge part of a rear lower side of the support plate 71 inclined in a state that the frontward side is located lower, and is arranged along the edge part. The cloth support 73 is narrower and shorter than the cloth support 72 and is arranged at a position close to an upper front side of the cloth support 72 such as to be contained in an inner side of the cloth support 72. The cloth support 74 is wider than the cloth support 72 and is arranged upper frontward of the cloth support 72 in a separated manner. The air receiving plate 75 is a flat plate having substantially the same size as the cloth support 72 and extends in parallel to the cloth support 72 at a position close to the rear lower side of the cloth support 72.

In the vicinity of an edge part of an upper front side of the support plate 71, a plurality of air ejection nozzles are supported at predetermined intervals. These nozzles are connected to an air supply (not illustrated) via individual air pipes 76 and then eject through the individual tips the air supplied via the individual air pipes 76.

The air ejection nozzles provided in the center portion eject air from the upper frontward of the cloth supports 72 and 73 toward a base part of the air receiving plate 75. The support plate 71 is provided with an air vent hole (not illustrated) opened on an upper front side of the air receiving plate 75 so that most of the ejected air is released through the air vent hole to a right side of the support plate 71. The air ejection nozzles provided on the front lower side eject air toward a lower right direction on a more front lower side than a front lower end part of the support plate 71. The air ejection nozzles provided on the rear upper side eject air toward a lower right direction on a more rear upper side than a rear upper end part of the support plate 71.

The correction device 7 having the above-described configuration is used such that: as indicated by a two-dot chain line in FIG. 2, an edge part of cloth W having a curled portion C is placed on the cloth support 74; then the cloth W is set in a state that a part of the cloth W between the edge parts on the front lower side and the rear upper side supported by the cloth support 74 is inserted between the cloth support 72 and the cloth support 73; and then air is ejected from the plurality of air ejection nozzles.

A tip part of the cloth W passes above the feed belt 5, then passes the turn-back device 4, and then is held between the needle plate 10 and the presser plate 33 in a state that the edge part is folded across a predetermined width. At that time, the cloth presser foot 6 is positioned at the distant position illustrated in FIG. 1. By virtue of this, the above-described setting work for the cloth W is allowed to be implemented without being disturbed by the presence of the cloth presser foot 6.

Sewing of the cloth W having been set in this manner is performed such that: the cloth presser foot 6 is lowered to the close position and, at the same time, the feed belt 5 is operated and air also is ejected from the air ejection nozzles of the turn-back device 4; and then the needle 32, the looper device, and the feed device are operated in synchronization with each other in association with the drive of the sewing machine motor.

In the correction device 7, the cloth W is moved in a state that the edge travels along the left side face of the support plate 71 and then, during this time, the air ejected from the plurality of air ejection nozzles is successively sprayed to the edge. The individual ejected air flows hit the curled portion C occurring in the edge part of the cloth W and acts such as to smooth out the curled portion C rightward. The cloth W is fed out in a state that the corrected edge where the curled portion C has been smoothed out travels along the left side face of the support plate 71.

The cloth W fed out in this manner passes the opposing portion of the cloth presser foot 6 and the feed belt 5 located in the close position, then is introduced into the turn-back device 4, and then reaches the needle location position in a state that the edge part has been folded across the constant width by virtue of the operation of the turn-back device 4 as described above. Then, the vicinity of the edge part is sewed at the needle location position so that the hem sewing is completed.

In the hem sewing implemented in this manner, in some cases, the edge of the cloth W is displaced in the right and left directions owing to the effect of an external force exerted during the feed movement. At that time, this displacement is enhanced in a case that the edge itself is curved. The main cause of the external force causing this displacement is the self-weight of the cloth W. That is, the cloth W having been set as illustrated in FIG. 2 constantly receives an external force in the left direction caused by the self-weight of the portion hanging down in outside of the tip part of the sewing machine bed 1. Thus, the edge of the cloth W is displaced leftward. This displacement occurs more remarkably in a case that the edge of the cloth W is curved.

The feed belt 5 and the cloth presser foot 6 are provided in order that the above-described displacement of the cloth W in the right and left directions may automatically be corrected so that the state of introduction into the turn-back device 4 may be made appropriate. This correction is implemented by raising or lowering the cloth presser foot 6 on the basis of the detection result of a detector 8 that is arranged in front of the opposing portion of the feed belt 5 and the cloth presser foot 6 and that detects the passage of the edge of the cloth W.

As illustrated in FIGS. 1 and 2, the detector 8 is supported by the support plate 71 of the correction device 7 and is located between the correction device 7 and the opposing portion of the feed belt 5 and the cloth presser foot 6. Then, for example, the detector 8 may be constructed from a photodetector provided with a light-emitting part and a light-receiving part arranged opposite to each other with, in between, the feed path for the edge (the cloth edge) of the cloth W fed from the correction device 7. In this configuration, in a case that the cloth edge passes at an appropriate position in the right and left directions, light emitted from the light-emitting part is blocked by the cloth edge so that the received light intensity of the light-receiving part decreases. On the other hand, in a case that the cloth W is displaced leftward and hence a position of the cloth edge is deviated, substantially the entire amount of light emitted from the light-emitting part reaches the light-receiving part so that the received light intensity of the light-receiving part increases. As such, the passage or non-passage of the cloth edge is allowed to be detected on the basis of the received light intensity of the light-receiving part.

Figure 4:
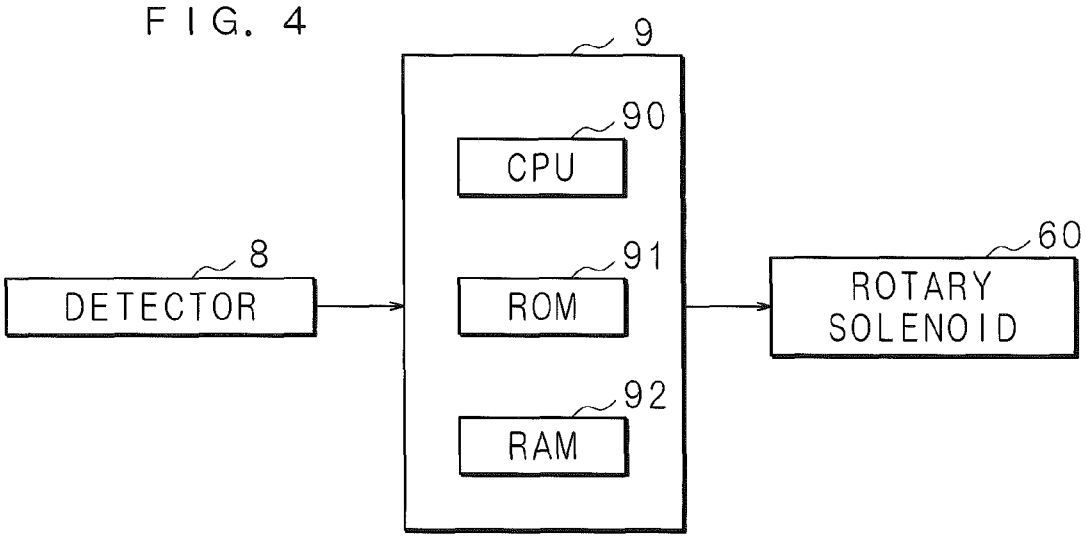
FIG. 4 is a block diagram illustrating a configuration of a control system for cloth-edge control operation.

FIG. 4 is a block diagram illustrating the configuration of a control system for cloth-edge control operation. The detection result of the detector 8 is provided to a control section 9. Then, the output of the control section 9 is provided to the rotary solenoid 60. The control section 9 is provided with a CPU 90, a ROM 91, and a RAM 92 and is constructed as a control section controlling the entire sewing operation of the sewing machine for hem according to the operation of the CPU 90 performed in accordance with a control program stored in the ROM 91. Then, the cloth-edge control operation described below is performed during the sewing operation.

Figure 5:
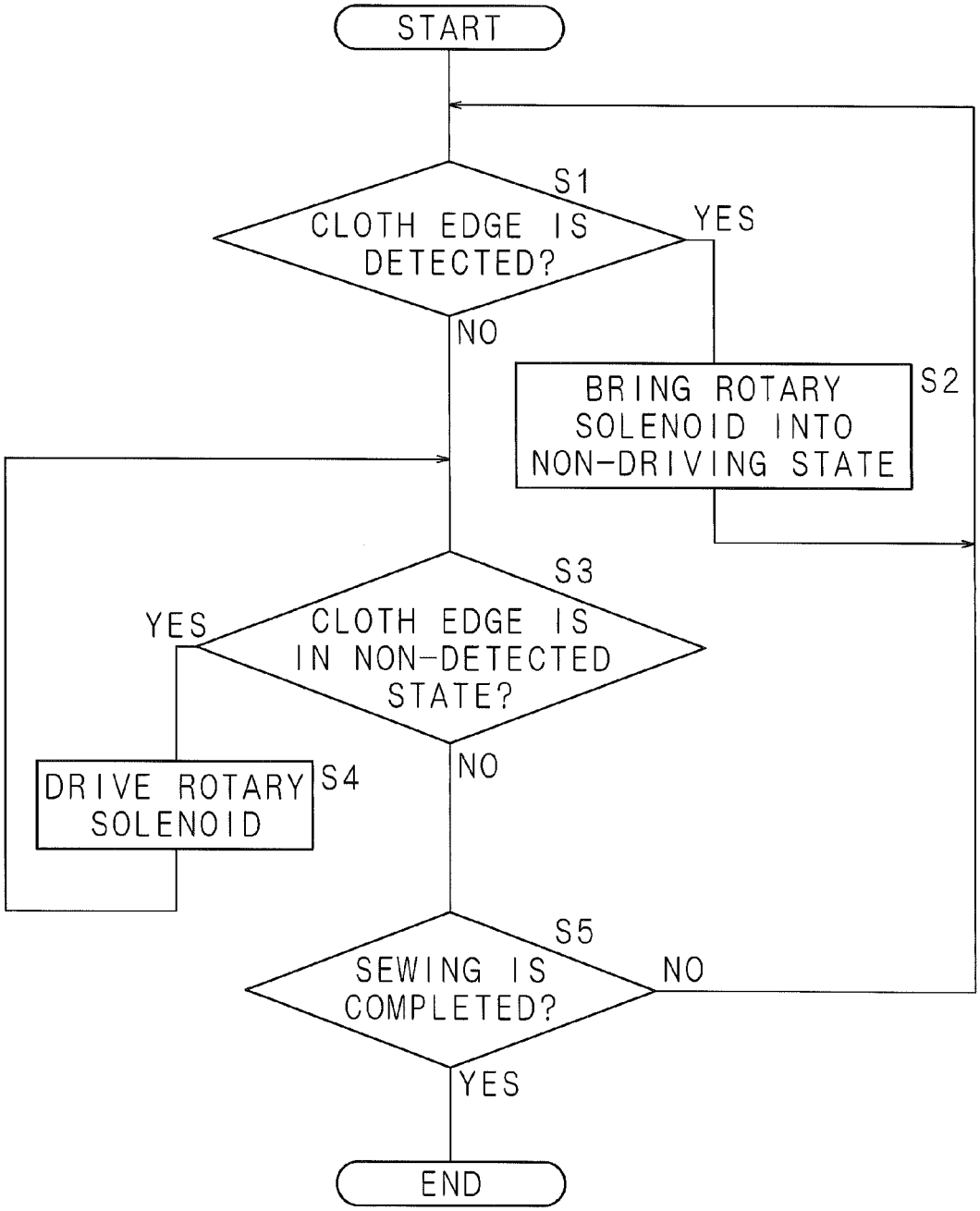
FIG. 5 is a flow chart illustrating a procedure of cloth-edge control operation.

FIG. 5 is a flow chart illustrating a procedure of cloth-edge control operation. The control section 9 starts the operation simultaneously to the start of sewing operation and then determines whether a cloth edge has been detected (step S1). Then, in case of being detected (S1: YES), the rotary solenoid 60 is brought into a non-driving state (step S2) and then this state is maintained until the cloth edge is no longer detected (S1: NO).

The determination at step S1 is performed such that the detection result of the detector 8, more specifically, the output of the light-receiving part, is incorporated into the CPU 90 and then the CPU 90 compares the data with a predetermined threshold. By virtue of the above-described operation, in a case that the cloth W is fed and moved without position deviation and hence the passing position of the cloth edge is appropriate, the rotary solenoid 60 is in the non-driving state and hence the cloth presser foot 6 is raised to the non-holding position illustrated in FIG. 3A. Thus, the cloth W passes without contact with the feed belt 5 and hence is fed into the turn-back device 4 and to the needle location position in a state that an appropriate position in the right and left directions is maintained.

Then, the control section 9 determines whether the cloth edge is in a non-detected state (step S3). In case of being in the non-detected state (S3: YES), the rotary solenoid 60 is driven (step S4) and then this driving is maintained until the non-detected state is resolved (S3: NO).

The determination at step S3 is performed similarly to step S1. By virtue of the above-described operation, in a case that position deviation of the cloth W occurs during the feed movement and hence the passing position of the cloth edge is not appropriate, the rotary solenoid 60 is driven so that the cloth presser foot 6 is lowered to the holding position illustrated in FIG. 3B. As a result, the cloth W is pressed against the feed surface of the feed belt 5 so that a movement force is exerted by the friction with the feed surface. Thus, the position deviation of the cloth W is resolved so that the cloth W is restored to the appropriate position in the right and left directions.

Here, it is sufficient that the feed belt 5 always rotates in a direction opposite to the direction of position deviation expected in the cloth W. As described above, in a case that leftward displacement occurs in the cloth W, the rotation direction of the feed belt 5 is set up such that the moving direction of the feed surface becomes rightward. By virtue of this, the cloth W moves rightward by virtue of the pressing against the feed belt 5 so that the position deviation is allowed to be resolved.

Then, the control section 9 determines whether sewing has been completed (step S5). If the sewing operation is continuing (S5: NO), the procedure is returned to step S1 so that the above-described operation is continued. If sewing operation has been completed (S5: YES), the series of operations are terminated.

As described above, in the sewing machine for hem of the embodiment, by virtue of the operation of the control section 9 performed on the basis of the detection result of the detector 8, the cloth presser foot 6 is raised and lowered so as to press the cloth W against the feed belt 5. Thus, the cloth W is fed into the turn-back device 4 and to the needle location position in a state that the displacement in the right and left directions is automatically corrected. Accordingly, without the necessity of assisting work by the operator, satisfactory hem sewing is allowed to be implemented.

The detector 8 may be provided at an appropriate position as long as the position is located in front of the opposing portion of the feed belt 5 and the cloth presser foot 6. However, in a case that the detector 8 is provided on the outlet side of the correction device 7 as described in the embodiment, the edge is detected in a state that the curled portion C is corrected and smoothed out. This permits more accurate position adjustment.

Here, it is to be noted that the embodiment disclosed here is illustrative and not restrictive at all points. The scope of the present invention is defined not by the description given above but by the claims and, further, includes all changes falling within the spirit and the scope of the claims. Further, in the present specification and the attached claims, any item described in the singular includes such items in the plurality unless indicated specifically in the context.

What is claimed is:

1. A sewing machine for hem, comprising:

a turn-back device arranged in front of a needle location position on a sewing machine bed, the turn-back device turning back an edge part of cloth into a state of being folded one above the other, and then feeding the turned-back cloth to the needle location position;

a feed belt arranged in front of the turn-back device and moving in right and left directions below a cloth feeding path;

a cloth presser foot opposing the feed belt with the cloth feeding path in between;

a drive section raising or lowering the cloth presser foot between a holding position where the cloth presser foot is lowered so as to hold the cloth in cooperation with the feed belt and a non-holding position where the cloth presser foot is raised so as to be away from the feed belt;

a detector arranged in front of an opposing portion of the feed belt and the cloth presser foot, and detecting passage of an edge of cloth; and a control section causing the drive section to operate so as to raise or lower the cloth presser foot between the holding position and the non-holding position, on the basis of detection by the detector.

2. The sewing machine for hem according to claim 1, further comprising a correction device arranged in front of the opposing portion of the feed belt and the cloth presser foot, and correcting curl occurring in an edge part of cloth, wherein the detector is arranged between the correction device and the opposing portion of the feed belt and the cloth presser foot.

3. The sewing machine for hem according to claim 1, wherein the cloth presser foot is provided with a presser ball rolling in contact with cloth, in a portion of opposing the feed belt.

4. The sewing machine for hem according to claim 1, further comprising a raising/lowering section raising or lowering the cloth presser foot together with the drive section between a distant position distant above the feed belt and a close position close to the feed belt.

5. The sewing machine for hem according to claim 1, wherein the drive section is provided with: a rotary solenoid lowering the cloth presser foot; and a bias spring raising the cloth presser foot.

* * * * *